United States Patent [19]

Chang et al.

[11] Patent Number: 4,552,275

[45] Date of Patent: Nov. 12, 1985

[54] PRESSURIZED FLUID PACKAGE

[75] Inventors: Long F. Chang, Sylvania; Frank Patek, Jr., Whitehouse, both of Ohio

[73] Assignee: Owens-Illinois, Inc., Toledo, Ohio

[21] Appl. No.: 553,264

[22] Filed: Nov. 18, 1983

Related U.S. Application Data

[63] Continuation-in-part of Ser. No. 333,074, Dec. 21, 1981, abandoned.

[51] Int. Cl.[4] ..... B65D 23/00; B65D 23/08

[52] U.S. Cl. ..... 215/12 R; 215/1 C; 215/100 R; 220/69; 248/346

[58] Field of Search ..... 215/1 R, 1 C, 12 R, 215/100 R; 220/69; 248/346, 346.1

[56] References Cited

U.S. PATENT DOCUMENTS

| | | | |
|---|---|---|---|
| 3,482,724 | 12/1969 | Heaton | 215/1 C X |
| 3,565,281 | 2/1971 | Collie | 220/69 |
| 3,632,015 | 1/1972 | Barth | 220/69 |
| 3,638,826 | 2/1972 | Barker et al. | 220/69 |
| 3,726,429 | 4/1973 | Doughty | 215/1 C |
| 3,727,782 | 4/1973 | Doughty | 215/1 C |
| 3,927,782 | 12/1975 | Edwards | 215/1 C X |
| 4,138,026 | 2/1979 | Conklin | 215/12 R |
| 4,219,124 | 8/1980 | Amberg | 215/12 R |
| 4,241,839 | 12/1980 | Alberghini | 215/1 C X |
| 4,293,359 | 10/1981 | Jakobsen | 215/1 C X |
| 4,326,638 | 4/1982 | Nickel et al. | 215/12 R |
| 4,331,246 | 5/1982 | Sorensen | 215/1 C |

FOREIGN PATENT DOCUMENTS

| | | | |
|---|---|---|---|
| 2057393 | 5/1972 | Fed. Rep. of Germany | 215/12 R |

*Primary Examiner*—William T. Dixson, Jr.
*Assistant Examiner*—Sue A. Weaver
*Attorney, Agent, or Firm*—Philip M. Rice

[57] ABSTRACT

A pressurized fluid package comprising a plastic container and a base. The oriented plastic container includes a cylindrical side wall, a neck, a neck finish on the upper end of the neck for receiving a closure, and a hemispherical bottom wall. The plastic base includes a seating area for engaging a surface on which the package is supported, and a peripheral wall extending upwardly and outwardly and terminating in an annular free edge portion defining an inner primary support area engaging a complementary area of the hemispherical wall of the container to provide primary and sole support axially for the container in the base. The base also has a second contact area for receiving adhesive to bond the hemispherical bottom wall of the container.

18 Claims, 8 Drawing Figures

FIG. 5
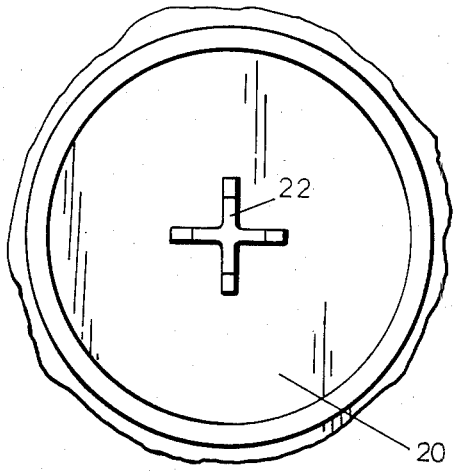
FIG. 4
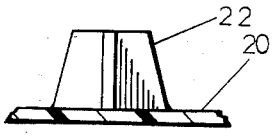
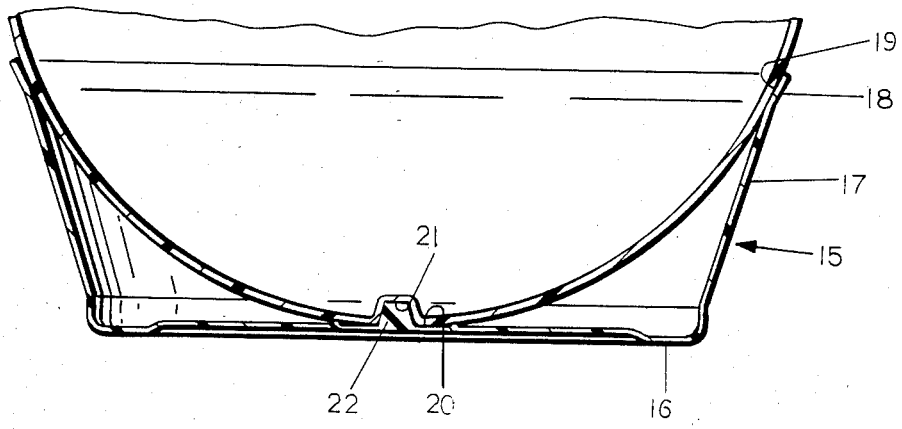
FIG. 2

PRESSURIZED FLUID PACKAGE

This application is a continuation-in-part of application Ser. No. 333,074 filed Dec. 21, 1981, now abandoned.

This invention relates to pressurized fluid packages for pressurized fluids such as carbonated beverages.

BACKGROUND AND SUMMARY OF THE INVENTION

A bottle generally consists of a shoulder portion with an opening, a side wall or main body which is generally cylindrical in shape, and a bottom joining the side wall. Because of the tendency of the wall of the pressurized plastic bottle to creep under internal pressure, it is a general practice to orient the plastic material and to design the bottle shape in such a way to improve resistance against creep. For the bottom section, it is known that if a uniform material distribution is achieved, the stress caused by the internal pressure can be minimized by using an outwardly hemispherical configuration. Molecular orientation can be obtained by blowing a properly designed parison in a blow mold in the orientation temperature region to enhance the strength. The hemispherical configuration, requires a separate means of support to make the bottle stand upright. For this purpose, a base cup is normally used.

In the handling of pressurized fluid containers during filling and storage, an important consideration is the resistance of the container to top load and the rigidity of the container.

One type of base cup used commercially includes an annular support area adapted to engage the hemispherical portion of the bottle. The support area is spaced radially inwardly of the peripheral wall of the cup. Such a construction provides satisfactory support and stability under most conditions. It has also been suggested that a secondary support area may be provided by a re-entrant portion of the side wall of the cup, as shown in U.S. Pat. Nos. 3,927,782 and 4,187,276. However, this provided only an additional support since the wall is capable of axial deformation.

Where the container is to be utilized for carbonated beverages that are pasteurized, such as beer, the pasteurization is conducted at elevated temperatures and prolonged exposure to these temperatures may cause deformation of the plastic material. Accordingly, it is desirable to provide a configuration of the pressurized fluid package which will expose the greatest possible surface of the package directly to the pasteurization thereby minimizing the time and the resultant adverse effects of prolonged exposure to high temperatures.

Among the objectives of the present invention are to provide a pressurized fluid package which utilizes a container and a separate base wherein the package has resistance to top load and increased rigidity.

In accordance with the invention the pressurized fluid package comprises an oriented plastic container and a base. The oriented plastic container includes a cylindrical side wall, a neck, a neck finish on the upper end of the neck for receiving a closure, and a hemispherical bottom wall. The plastic base includes a seating area for engaging a surface on which the package is supported, and a peripheral wall extending upwardly and outwardly and terminating in an annular free edge portion defining an inner primary support area engaging a complementary area of the hemispherical wall of the container to provide primary and sole support axially for the container in the base. The base has a second contact area for receiving adhesive to bond the hemispherical bottom wall of the container.

DESCRIPTION OF THE DRAWINGS

FIG. 2 is a fragmentary sectional view on an enlarged scale of a portion of the package shown in FIG. 1.

FIG. 4 is a fragmentary elevational view on an enlarged scale of a portion of the base.

FIG. 5 is a fragmentary plan view on an enlarged scale of a portion of the base.

DESCRIPTION

Figure 1:
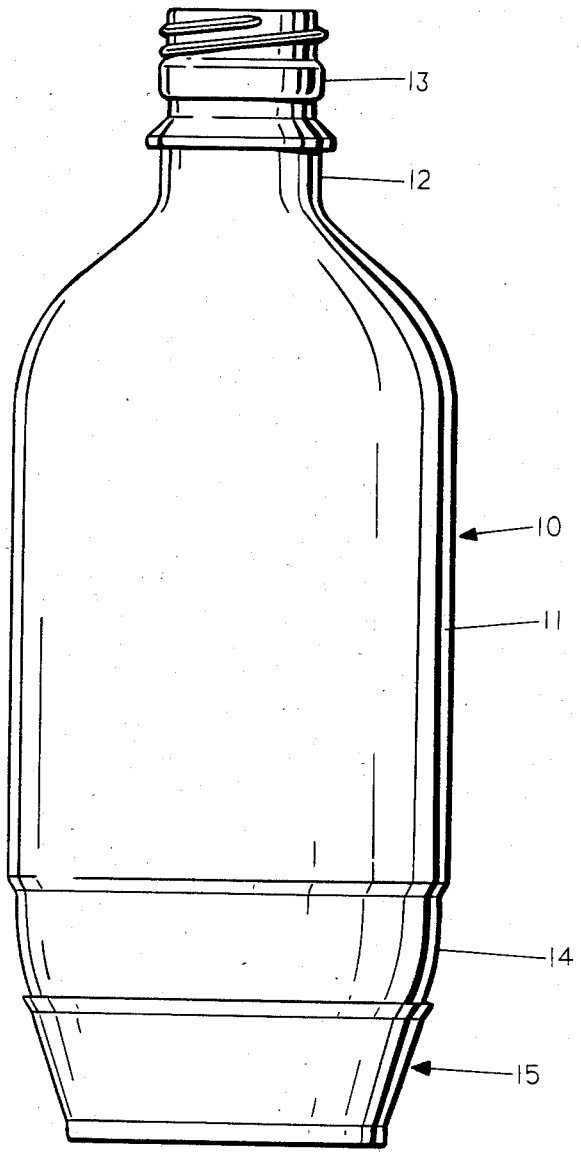
FIG. 1 is an elevational view of a package embodying the invention.
Figure 3:
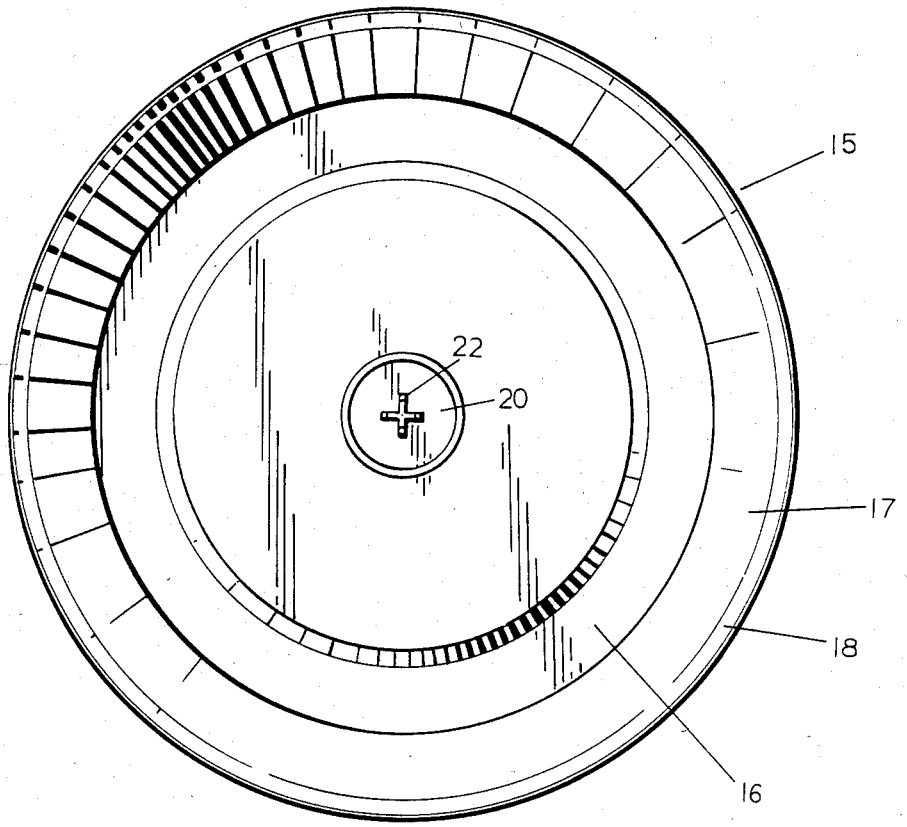
FIG. 3 is a plan view of the base.

Referring to FIG. 1, the pressurized fluid package embodying the invention comprises an oriented plastic container 10 made of plastic material such as polyethylene terephthalate and made by well-known methods to have a cylindrical side wall 11, a neck 12, a neck finish 13 for receiving a closure and a hemispherical bottom wall 14. It is well-known that a hemispherical configuration of the bottom wall provides optimum resistance to internal pressure.

The package further includes a base 15 which in accordance with the invention has a seating area 16 in the form of an annular flat portion engaging a supporting surface, a peripheral annular inverted frustoconical wall 17 which tapers upwardly and outwardly terminating in an annular inverted frustoconical free portion 18 that has an internal surface 19 that is tangential to a portion of the upper end of the hemispherical bottom wall 14 of the container 10. This forms a primary and sole support area for the container 10 in the base 15. The base is made of plastic such as polyethylene.

The base 15 further includes a central secondary contact area 20 that receives adhesive to bond the central portion of the hemispherical bottom wall of the container. The container also includes an axially extending recess 21 for receiving a cruciform shaped projection 22 that extends upwardly from the bottom wall of the base. The construction and arrangement of the recess and projection are disclosed and claimed in application Ser. No. 332,624 filed Dec. 21, 1981, having a common assignee with the present application. The recess and projection function to hold the container in position axially with respect to the base during the setting of the adhesive that is applied to the contact area 20.

In accordance with the invention, the provision of the primary support area 19 at the upper periphery of the wall 17 of the base 15 aids both axial or top load resistance as well as line stability in the handling of the container during filling. The primary support area 19 functions to provide the sole load bearing area and the secondary contact area 20 functions substantially solely to receive adhesive for the adherence of the base to the container.

It has been found that the annular free supporting portion that performs the primary load bearing area of the container is positioned for tangential engagement with the hemispherical bottom wall at the upper periphery of the bottom wall and preferably at an angle ranging from 50° to 75° with a transverse plane intersecting the axis of the container.

Adhesive is preferably provided in the area 20 associated with the center portion 22 of the base 15.

Figure 7:
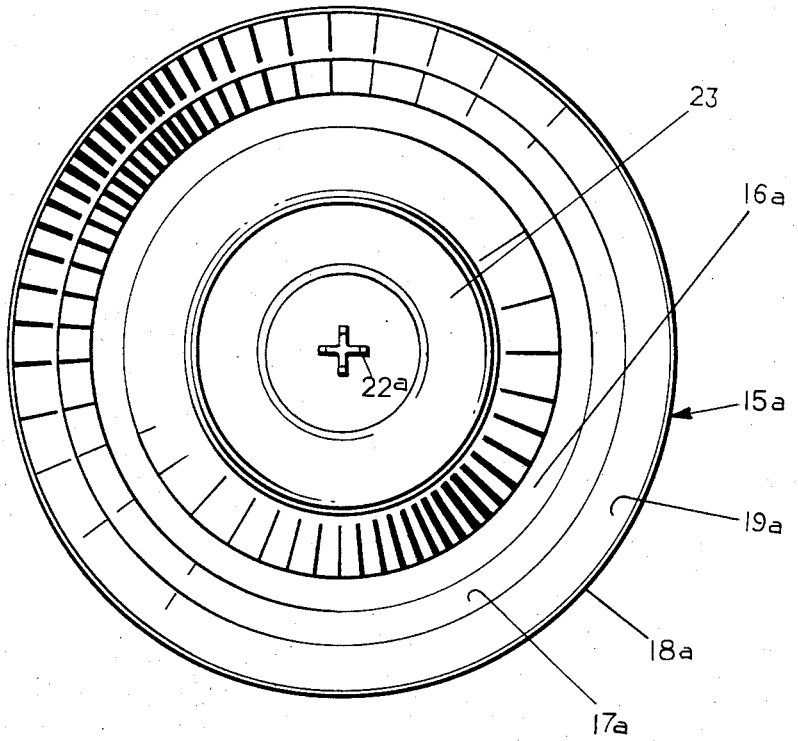
FIG. 7 is a plan view of the base of the package shown in FIG. 6.
Figure 6:
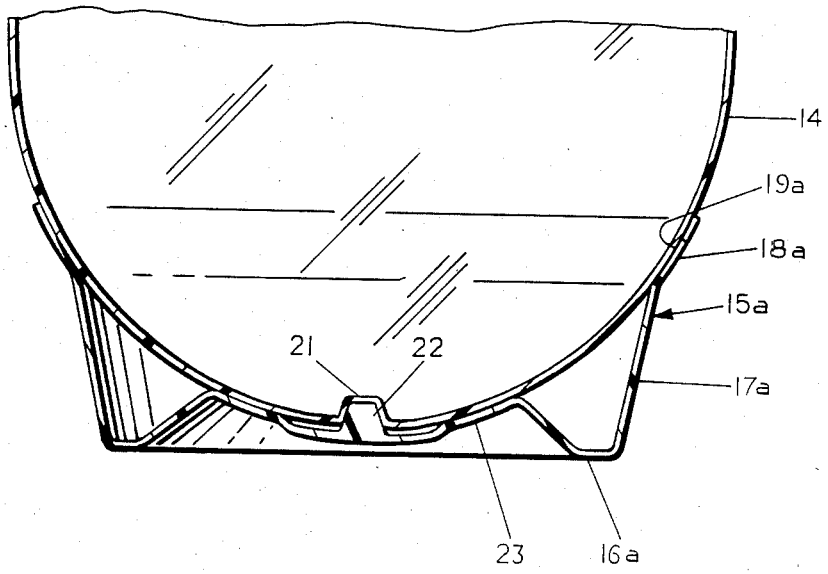
FIG. 6 is a fragmentary sectional view of a modified form of package.

In the form of the invention shown in FIGS. 6 and 7, the secondary contact area is in the form of an annular surface 23 in the bottom wall of the base 15*a* engaging complementary portion of the hemispherical bottom wall 14 of the container 10. The remainder of the base is substantially the same, corresponding parts having corresponding reference numerals for clarity.

The package results in substantial savings in the material of the base and improved top load strength.

Figure 8:
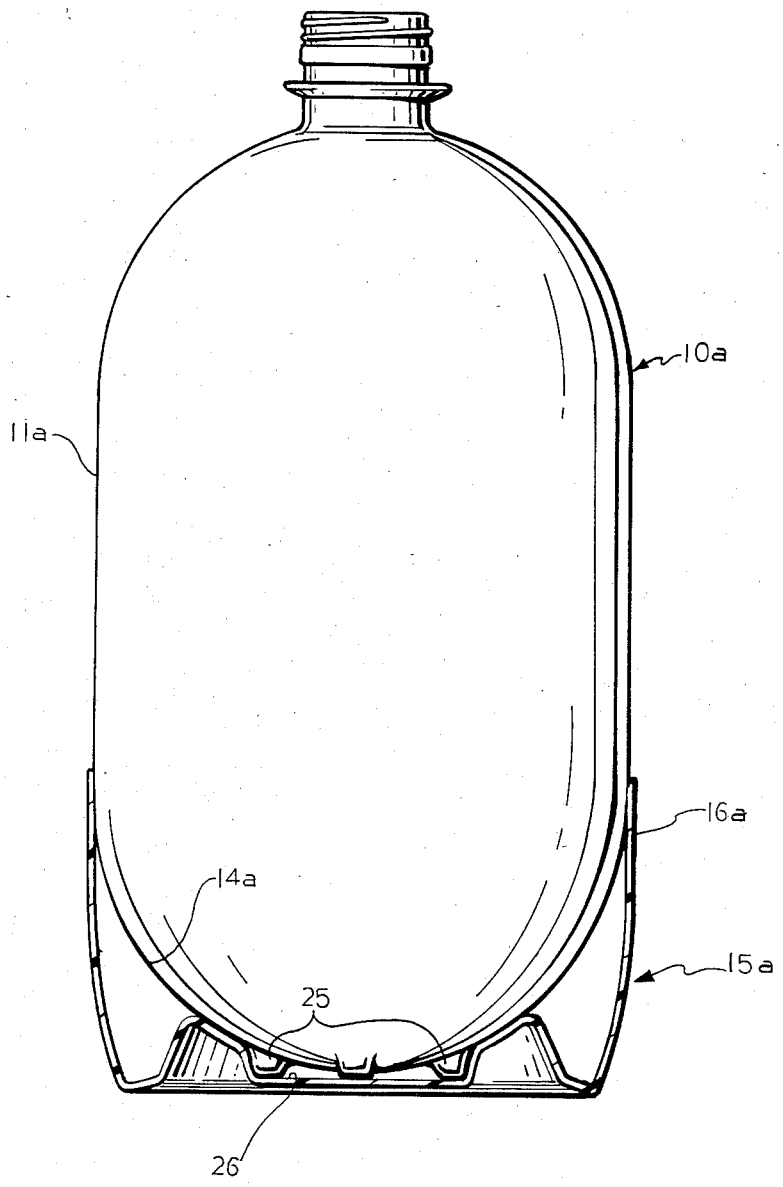
FIG. 8 is an elevational view of a modified form of package embodying the invention.

While in the preferred embodiment the fluid package contains pressurized fluids, such as carbonated beverages, the package and base cup may be used with non-pressurized contents. Similarly, while in the preferred embodiment the plastic container is molecularly oriented, unoriented containers may be used for some purpose where the increased physical properties due to orientation are not required.

Where the container is made large and is intended for holding carbonated beverages such as beer, it may take the form shown in FIG. 8, shown as for holding one gallon, wherein the container 10*a* ratio of the length to the diameter is less than that shown in FIG. 1. However, as in the form shown in FIG. 1, the free terminal portion 16*a* of the base 15*a* tangentially engages the hemispherical bottom wall 14*a* adjacent the upper end of the hemispherical bottom near the juncture to the cylindrical wall 11*a* portion at an angle ranging between 50° and 75° and forms the sole load bearing area.

In this form, the interengaging means between the hemispherical portion and the base 15*a* comprises a plurality of small circumferentially spaced projections 25 that engage an annular recess 26 in the base wall of the base 15*a* as disclosed and claimed in my U.S. application Ser. No. 422,062 filed Sept. 23, 1982, incorporated herein by reference. As indicated above, in each form, the free terminal portion of each base tangentially engages the hemispherical bottom wall of the container adjacent the upper end of the hemispherical near the juncture of the cylindrical wall and the hemispherical bottom at an angle ranging between 50° and 75°.

Preferred angles depend on the size of the container and preferably are as follows:

one half liter: 54°–65°
one liter: 59°–65.5°
two liter: 58°–65°
one ga11on: 62.5°–70°

It can thus be seen that the provision of a primary support area that performs substantially the sole load bearing function as a point along the hemispherical bottom wall results in the avoidance of areas of high stress on the hemispherical bottom wall and thereby obviates any tendency to deform the bottom wall of the container.

We claim:

1. A pressurized fluid package comprising an oriented plastic container including a cylindrical side wall, a neck, a neck finish on the upper end of the neck for receiving a closure, and a hemispherical bottom wall, a plastic base including an annular seating area for engaging a surface on which the package is supported, said base having a peripheral annular inverted frustoconical wall extending upwardly and outwardly and terminating in an annular frustoconical free edge portion defining an inner primary support area tangentially engaging a complementary area of the upper end of the hemispherical wall of the container to provide primary support axially for the container in the base, said hemispherical bottom wall having a radius that is uniform throughout the bottom wall, said free edge portion of said frustoconical wall engaging the hemispherical wall and being tangential thereto at an angle ranging between 50° and 75° with a transverse plane through the axis of the base, said base having a second contact area for receiving adhesive to bond the hemispherical bottom wall of the container.

2. The pressurized fluid package set forth in claim 1 wherein said container has a central axially upwardly extending recess, said base having a cruciform projection extending axially upwardly into and engaging said recess.

3. The pressurized fluid package set forth in claim 1 wherein said second contact area is centrally located in the bottom of said base.

4. The pressurized fluid package set forth in claim 1 wherein said second contact area comprises an annular portion tangential to portions of the hemispherical wall of the container.

5. The pressurized fluid package set forth in claim 4 wherein said container has a central axially upwardly extending recess, said base having a cruciform projection extending axially upwardly into and engaging said recess.

6. The pressurized fluid package set forth in claim 1 wherein said container comprises a one-half liter container and the angle ranges between 54° and 65°.

7. The pressurized fluid package set forth in claim 1 wherein said container comprises a one liter container and the angle ranges between 59°–65.5°.

8. The pressurized fluid package set forth in claim 1 wherein said container comprises a two liter container and the angle ranges between 58°–65°.

9. The pressurized fluid package set forth in claim 1 wherein said container comprises a one gallon container and the angle ranges between 62.5°–70°.

10. A base for an oriented plastic container including a cylindrical side wall, a neck finish on the upper end of the neck for receiving a closure, and a hemispherical bottom wall having a radius that is uniform throughout the bottom wall, said base being made of plastic and including an annular seating area for engaging a surface on which the package is supported, said base having a peripheral annular inverted frustoconical wall extending upwardly and outwardly and terminating in an annular frustoconical free edge portion defining an inner primary support area tangentially engaging a complementary area of the upper end of the hemispherical wall of a container to provide primary support axially for the container in the base, said free edge of said frustoconical wall adapted to engage the hemispherical wall and be tangential thereto at an angle ranging between 50° and 75° with a transverse plane through the axis of the base, said base having a second contact area for receiving adhesive to bond the hemispherical bottom wall of a container.

11. The base set forth in claim 10 wherein said base has a cruciform projection extending axially upwardly and adapted to extend into and engage a central axially extending recess in a container.

12. The base set forth in claim 10 wherein said second contact area is centrally located in the bottom of said base.

13. The base set forth in claim 10 wherein said second contact area comprises an annular portion tangential to portions of the hemispherical wall of a container.

14. The base set forth in claim 13 wherein said base has a cruciform projection extending axially upwardly and adapted to extend into and engage a central axially extending recess in a container.

15. The base set forth in claim 10 wherein the angle ranges between 54° and 65°.

16. The base set forth in claim 10 wherein the angle ranges between 59°–65.5°.

17. The base set forth in claim 10 wherein the angle ranges between 58°–65°.

18. The base set forth in claim 10 wherein the angle ranges between 62.5°–70°.

* * * * *